US008596384B2

(12) United States Patent
Villareal et al.

(10) Patent No.: US 8,596,384 B2
(45) Date of Patent: Dec. 3, 2013

(54) REDUCING DIFFERENTIAL STICKING DURING SAMPLING

(75) Inventors: Steven Villareal, Houston, TX (US); Julian J. Pop, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 286 days.

(21) Appl. No.: 12/697,401

(22) Filed: Feb. 1, 2010

(65) Prior Publication Data

US 2010/0200228 A1 Aug. 12, 2010

Related U.S. Application Data

(60) Provisional application No. 61/150,573, filed on Feb. 6, 2009.

(51) Int. Cl.
*E21B 49/00* (2006.01)

(52) U.S. Cl.
USPC ..... 175/59; 175/50; 166/264

(58) Field of Classification Search
USPC ..... 166/264, 100; 175/59, 42, 50
See application file for complete search history.

(56) References Cited

U.S. PATENT DOCUMENTS

| | | | | |
|---|---|---|---|---|
| 3,254,531 | A * | 6/1966 | Briggs, Jr. | 73/152.24 |
| 4,547,691 | A | 10/1985 | Valdois et al. | |
| 4,549,431 | A * | 10/1985 | Soeiinah | 73/152.49 |
| 4,976,143 | A | 12/1990 | Casso | |
| 4,994,671 | A * | 2/1991 | Safinya et al. | 250/255 |
| 5,329,811 | A | 7/1994 | Schultz et al. | |
| 5,377,755 | A * | 1/1995 | Michaels et al. | 166/264 |
| 5,394,345 | A | 2/1995 | Berard et al. | |
| 5,939,717 | A | 8/1999 | Mullins | |
| 6,274,865 | B1 | 8/2001 | Schroer et al. | |
| 6,350,986 | B1 | 2/2002 | Mullins et al. | |
| 6,476,384 | B1 | 11/2002 | Mullins et al. | |
| 6,729,400 | B2 * | 5/2004 | Mullins et al. | 166/264 |
| 6,832,515 | B2 | 12/2004 | Follini et al. | |
| 7,062,958 | B2 * | 6/2006 | Diakonov et al. | 73/152.23 |
| 7,114,562 | B2 | 10/2006 | Fisseler et al. | |
| 7,178,392 | B2 | 2/2007 | Dhruva et al. | |
| 7,367,394 | B2 | 5/2008 | Villareal et al. | |
| 7,379,180 | B2 | 5/2008 | Vannuffelen et al. | |
| 7,805,247 | B2 | 9/2010 | Hsu et al. | |

(Continued)

OTHER PUBLICATIONS

Golzalpour, F. et al., Predicting Reservoir Fluid Phase and Volumetric Behavior from Samples Contaminated with Oil-Based Mud, SPE 78130, pp. 197-205.

(Continued)

*Primary Examiner* — Giovanna Wright
*Assistant Examiner* — Ronald Runyan
(74) *Attorney, Agent, or Firm* — Cathy Hewitt; John Vereb

(57) ABSTRACT

Methods comprising lowering a downhole tool via a pipe into a wellbore drilled through a formation via the pipe, establishing fluid communication between the downhole tool and the formation at a location in the wellbore, extracting from the formation a first fluid stream and passing the first fluid stream through the downhole tool for a first duration, breaking fluid communication between the downhole tool and the formation, reestablishing fluid communication between the downhole tool and the formation essentially at the location in the wellbore, extracting from the formation a second fluid stream and passing the second fluid stream through the downhole tool for a second duration, and capturing in the downhole tool a fluid sample of the second fluid stream.mud.

20 Claims, 4 Drawing Sheets

(56) References Cited

U.S. PATENT DOCUMENTS

| | | | | |
|---|---|---|---|---|
| 2006/0283606 | A1 | 12/2006 | Partouche et al. | |
| 2008/0037006 | A1 | 2/2008 | Canas Triana et al. | |
| 2008/0087470 | A1 * | 4/2008 | Villareal et al. | 175/50 |
| 2008/0156088 | A1 | 7/2008 | Hsu et al. | |
| 2008/0156486 | A1 | 7/2008 | Ciglenec et al. | |
| 2008/0156487 | A1 | 7/2008 | Zazovsky et al. | |
| 2008/0173445 | A1 | 7/2008 | Dong et al. | |
| 2008/0257036 | A1 | 10/2008 | Chaudoreille et al. | |
| 2008/0308279 | A1 | 12/2008 | Zazovsky et al. | |
| 2008/0314587 | A1 | 12/2008 | Del Campo et al. | |

OTHER PUBLICATIONS

C. Dong et al., New Downhole Fluid Analyzer Tool for Improved Reservoir Characterization, SPE 108566, pp. 1-11.

W.B. Underhill et al., Model-Based Sticking Risk Assessment for Wireline Formation Testing Tools in the U.S. Gulf Coast, SPE 48963, pp. 79-89.

GB Search Report, Application No. 1001620.2, dated May 10, 2010, p. 24.

J. D. Sherwood, Differential Pressure Sticking of Drill String, AIChE Journal, vol. 44, No. 3, Mar. 1998, Schlumberger Cambridge Research, Cambridge CB3, 0EL, U.K., pp. 711-721.

* cited by examiner

REDUCING DIFFERENTIAL STICKING DURING SAMPLING

BACKGROUND OF THE DISCLOSURE

Wellbores are usually drilled over-balanced, where the pressure of the wellbore fluid is maintained to be greater than the pore pressure in the formations being drilled. Drilling over balanced may be useful to limit the amount of hydrocarbon flowing from formations into the well, and therefore may limit the risk of a well "blowout" and/or exposure to (toxic) formation gases at the wellsite. When drilling over-balanced, wellbore fluid (such as drilling mud filtrate) gradually seeps into the formation pore space in the proximity of the wellbore. As wellbore fluid invades the formation, a mud cake may be formed at the wellbore wall, and the filtration process may gradually diminish. It should be appreciated that the mud cake buildup and/or the invasion process(es) may take hours, and even days, depending on the formation and the constitution of the mud.

When a downhole tool is disposed in a wellbore (for example, to take a sample, to perform a drill stem test, etc.), a probe, a packer, a portion of the downhole tool body, or a combination thereof is usually pressed against the wellbore wall. One or more of these components may compact the mud cake and create a progressively sealed surface between the wellbore and the formation. On the side in contact with the formation wall, the sealed surface may be exposed to a pressure level substantially lower than the wellbore pressure level (typically close to the formation pressure level). Thereby, the sealed surface may be subjected to a net force urging the downhole tool against the wellbore wall. The net force usually increases in magnitude when the time on station increases. In some cases, the net force may prevent further movement of the downhole tool in the wellbore, resulting in expensive fishing operations, or abandoning the well. This problem, well known in the art, is sometimes referred to as differential sticking.

It should be appreciated that logging while drilling tools may be more prone to differential sticking than wireline tools, in particular because the mud cake may be still forming at the time logging while drilling tools are operated. Also, it should be appreciated that sampling tools, testing tools, or more generally downhole tools sometimes referred to as station tools, are more prone to differential sticking, in particular because these tools usually perform measurements over an extended period of time (such as 20 minutes or more) at essentially the same location in the wellbore.

RELATED ART

"Apparatus and Method for Unsticking a Downhole Tool," U.S. patent application Ser. No. 11/763,018, filed Jun. 4, 2007, published as US2008/0308279, which is hereby incorporated by reference in its entirety, provides a downhole tool including apparatus for releasing the tool from the wall or a borehole. The tool may include a housing defining a longitudinal axis and a sleeve coupled to the housing and mounted for rotation relative to the housing, the sleeve having an exterior surface including at least one projection extending radially outwardly with respect to the longitudinal axis. A transmission mechanism may be coupled to and adapted to rotate the sleeve, and a motor may be coupled to the transmission mechanism. A method for releasing the downhole tool by rotating a sleeve is also disclosed.

"Downhole Tool Having an Extendable Component with a Pivoting Element," U.S. patent application Ser. No. 11/766, 364, filed Jun. 21, 2007, published as US2008/0314587, which is hereby incorporated by reference in its entirety, provides an extendable component for use in a downhole tool for traversing subsurface formations. The component includes a drive element that defines an axis and has a distal end, and an abutment that is spaced radially from a distal end of the drive element. A driven element defines a driven element axis, is flexibly coupled to the drive element, and includes a proximal end disposed adjacent to the drive element and a distal end. A tilt arm is coupled to the driven element, is disposed at an angle with respect to the driven element axis, and is configured to engage the abutment. The driven element is moveable between a normal position and a tilted position. A contact head is coupled to the driven element distal end and is adapted to engage the wellbore wall.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
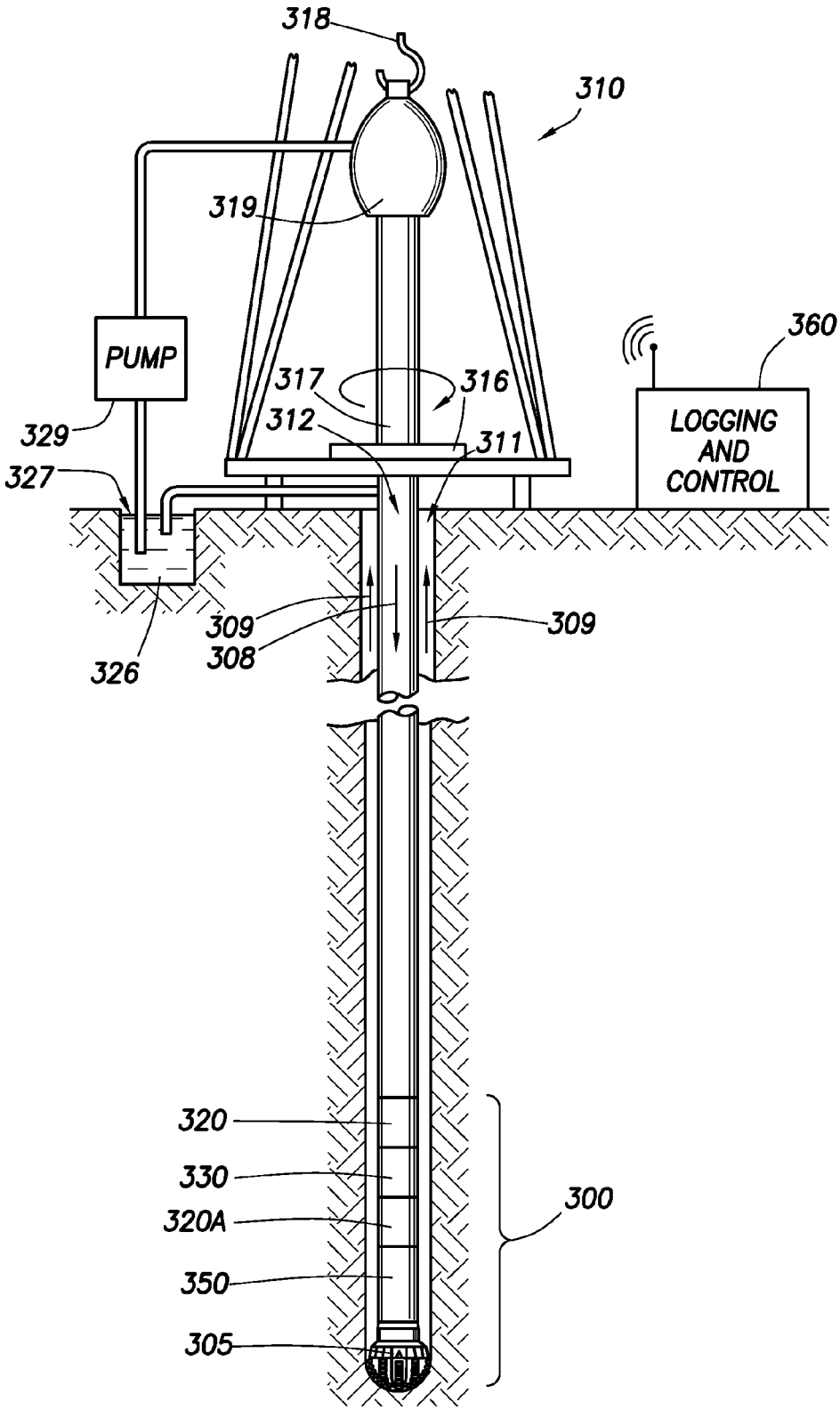
FIG. 1A is a cross-sectional view of a downhole tool according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure introduces a method comprising lowering a downhole tool via a pipe into a wellbore drilled through a formation via the pipe, establishing fluid communication between the downhole tool and the formation at a location in the wellbore, extracting fluid from the formation, and passing the fluid through the downhole tool for a first duration. Fluid communication between the downhole tool and the formation is then broken, and the pipe is moved in the wellbore. Fluid communication is then established between the downhole tool and the formation at essentially the same location in the wellbore. Fluid is then extracted from the formation and passed through the downhole tool for a second duration. A fluid sample is then captured in the downhole tool.

Such method may further comprise measuring the composition of the fluid stream passing through the tool. The method may also comprise comparing the measured composition with a model or expected composition. Alternately, or in combination, the method may further comprise measuring a parameter indicative of a fraction of mud filtrate or formation connate fluid in the fluid extracted from the formation. The method may further comprise comparing the inferred filtrate fraction with a prediction based on a model and deciding subsequent steps in the sampling process. The method may further comprise performing a sticking test. The method may also comprise a plurality of pumping phases interrupted by sampling tool movements in the wellbore. A drill bit may be connected at a distal end of the pipe, and the method may further comprise drilling the formation.

Any of the first and second durations may be predetermined (for example, by the predictions of a model simulating the sampling operations, by well or operating conditions, etc). Alternatively, the length may be determined from sticking models, in combination with sticking tests performed in situ. The number of pumping phases may be determined, for example, by inspection, namely, by determining whether the rate of decline of the filtrate fraction as determined from the indicative parameter, is satisfactory; and/or by utilizing a model capable of predicting, given the current status of contamination, the time to reach a desired level of contamination in the pumped fluid.

The present disclosure also introduces a method comprising lowering a downhole tool via a pipe into a wellbore drilled through a formation via the pipe, establishing fluid communication between the downhole tool and the formation at a location in the wellbore, extracting fluid from the formation, and passing the fluid through the downhole tool for a first duration. The fluid communication between the downhole tool and the formation is then broken, and the pipe is moved in the wellbore. A fluid communication is then established between the downhole tool and the formation at essentially the same location in the wellbore. Fluid is then extracted from the formation and passed through the downhole tool for a second duration. A property indicative of a composition of the extracted fluid during the first and second durations is then measured.

In such method, the measured property may be a spectrum, such as a mass spectrum, an optical spectrum or an NMR spectrum, which would allow the fingerprinting of the fluid. The spectra obtained during the successive pumping sequences may be compared or treated (e.g., by methods well known in the art) to determine if the pumped fluid was of sufficient quality to capture. Example methods of comparing or treating the spectra may include subtraction and skimming, such as described in SPE 78130. The measured property may alternatively or additionally be a tracer which has been mixed with the drilling mud in order to distinguish mud filtrate from the virgin reservoir fluid, for example tritium, or a dye, EMI600, which, in the latter case, is mixed with a water-based mud to distinguish by optical spectrometry means the mud filtrate from the formation water being sampled. The measured property may alternatively or additionally be a gas-oil ratio (GOR), or methane fraction.

Optionally, measuring a property indicative of a composition of the extracted fluid may further comprise determining at least one contamination value as determined by a fraction of mud filtrate in the fluid extracted from the formation. In this case, the proposed method may further comprise measuring a plurality of fluid property values indicative of a fraction of mud filtrate in the fluid extracted from the formation during the first duration, determining a contamination trend from the plurality of values, and comparing the at least one contamination value to the contamination trend.

The present disclosure also introduces a method comprising lowering a downhole via a pipe into a wellbore drilled through a formation via the pipe, establishing fluid communication between the downhole tool and the formation at a location in the wellbore, extracting fluid from the formation, and passing the fluid through the downhole tool for a first duration. The fluid communication between the downhole tool and the formation is then broken, and the pipe is moved in the wellbore. Fluid communication is then established between the downhole tool and the formation at essentially the same location in the wellbore, and fluid is then extracted from the formation and passed through the downhole tool for a second duration. A property indicative of an extracted fluid density and/or viscosity of the extracted fluid during the second duration is then measured. Such method may further comprise measuring an extracted fluid pressure, and extracted fluid temperature.

Figure 1B:
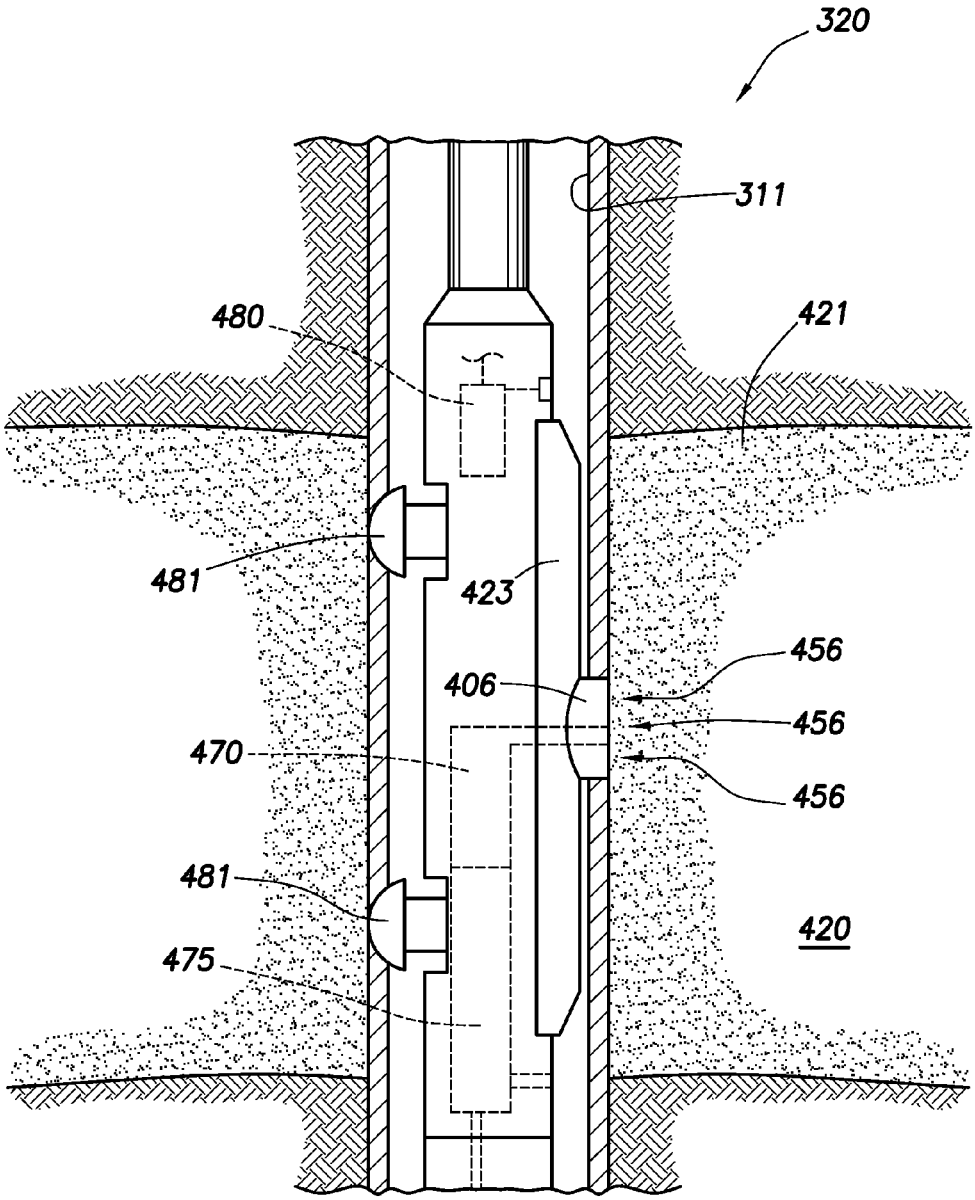
FIG. 1B is a cross-sectional view of a portion of the downhole tool shown in FIG. 1A.

Referring to FIGS. 1A and 1B, an example wellsite system is shown that may be used to implement one or more aspects of the present disclosure. The wellsite may be situated onshore (as shown) or offshore.

In the system of FIG. 1A, a wellbore 311 is drilled through subsurface formations by rotary drilling in a manner that is well known in the art. However, the present disclosure also contemplates others examples used in connection with directional drilling apparatus and methods, as will be described hereinafter.

A drill string 312 is suspended within the wellbore 311 and includes a bottom hole assembly ("BHA") 300 proximate the lower end thereof. The BHA 300 includes a drill bit 305 at its lower end. The surface portion of the wellsite system includes a platform and derrick assembly 310 positioned over the wellbore 311, the assembly 310 including a rotary table 316, kelly 317, hook 318 and rotary swivel 319. The drill string 312 is rotated by the rotary table 316, which is itself operated by well known means not shown in the drawing. The rotary table 316 engages the kelly 317 at the upper end of the drill string 312. As is well known, a top drive system (not shown) could alternatively be used instead of the kelly 317 and rotary table 316 to rotate the drill string 312 from the surface. The drill string 312 is suspended from the hook 318. The hook 318 is attached to a traveling block (also not shown), through the kelly 317 and the rotary swivel 319 which permits rotation of the drill string 312 relative to the hook 318. The travelling block may be moved vertically via a cable (not shown) reeled on rotatable sheaves (not shown) disposed on the travelling block. The cable may be used for monitoring a depth of components in the BHA 300, for example, as described in U.S. Pat. No. 4,976,143, the entirety of which is hereby incorporated herein by reference.

In the example of FIG. 1A, the surface system further includes drilling fluid ("mud") 326 stored in a tank or pit 327 formed at the wellsite. A pump 329 delivers the drilling fluid 326 to the interior of the drill string 312 via a port in the swivel 319, causing the drilling fluid 326 to flow downwardly through the drill string 312 as indicated by the directional arrow 308. The drilling fluid 326 exits the drill string 312 via water courses, or nozzles ("jets") in the drill bit 305, and then circulates upwardly through the annulus region between the outside of the drill string and the wall of the borehole, as indicated by the directional arrows 309. In this well known manner, the drilling fluid 326 lubricates the drill bit 305 and carries formation cuttings up to the surface, whereupon the drilling fluid 326 is cleaned and returned to the pit 327 for recirculation. It should be noted that in some implementations, the drill bit 305 may be omitted and the bottom hole assembly 300 may be conveyed via tubing, pipe or wireline within the scope of the present disclosure.

The bottom hole assembly 300 of the illustrated example may include a logging-while-drilling (LWD) module 320, a measuring-while-drilling (MWD) module 330, a rotary-steerable directional drilling system and hydraulically operated motor 350, and the drill bit 305.

The LWD module 320 is housed in a special type of drill collar, as is known in the art, and may contain one or a plurality of known types of well logging instruments. It will also be understood that more than one LWD module may be employed, e.g., as represented at 320A. (References, throughout, to a module at the position of LWD module 320 may alternatively mean a module at the position of LWD module 320A as well.) The LWD module 320 typically includes capabilities for measuring, processing, and storing information, as well as for communicating with the MWD 330. In particular, the LWD module 320 may include a processor configured to implement one or more aspects of the methods described herein. In the present embodiment, the LWD module 320 includes a fluid sampling device as will be further explained below.

The MWD module 330 is also housed in a special type of drill collar, as is known in the art, and may contain one or more devices for measuring characteristics of the drill string and drill bit. The MWD module 330 further includes an apparatus (not shown) for generating electrical power for the downhole portion of the wellsite system. Such apparatus typically includes a turbine generator powered by the flow of the drilling fluid 326, it being understood that other power and/or battery systems may be used while remaining within the scope of the present disclosure. In the present example, the MWD module 330 may include one or more of the following types of measuring devices: a weight-on-bit measuring device, a torque measuring device, a vibration measuring device, a shock measuring device, a stick slip measuring device, a direction measuring device, and an inclination measuring device. Optionally, the MWD module 330 may further comprise an annular pressure sensor, and a natural gamma ray sensor. The MWD module 330 typically includes capabilities for measuring, processing, and storing information, as well as for communicating with a logging and control unit 360. In some cases, the logging and control unit 360 may include a controller having an interface configured to receive commands from a surface operator.

A simplified diagram of a sampling-while-drilling logging device (e.g., the LWD tool 320 in FIG. 1A) is shown in FIG. 1B. The sampling-while-drilling logging device of FIG. 1B may be of a type described, for example, in U.S. Patent Application Publication No. 2008/0156486, the entirety of which is hereby incorporated herein by reference. However, other types of sampling-while-drilling logging devices may be used to implement the LWD tool 320 or portions thereof.

As shown in FIG. 1B, the LWD tool 320 may be provided with a stabilizer that may include one or more blades 423 configured to engage a wall of the borehole 311. The LWD tool 320 may be provided with a plurality of backup pistons 481 configured to assist in applying a force to push and/or move the LWD tool 320 against the wall of the borehole 311. The configuration of the blades 423 and/or of the backup pistons 481 may be of a type described, for example, in U.S. Pat. No. 7,114,562, the entirety of which is hereby incorporated herein by reference. However, other types of blade or piston configurations may be used to implement the LWD tool 320 within the scope of the present disclosure.

A probe 406 may extend from the stabilizer blade 423 of the LWD tool 320. The probe 406 may be configured to selectively seal off or isolate selected portions of the wall of the wellbore 311 to fluidly couple to an adjacent formation 420. The probe 406 may be a guard probe or a focused sampling probe, such as described in U.S. Patent Application Publication No. 2008/0156487, the entirety of which is hereby incorporated by reference. Once the probe 406 fluidly couples to the adjacent formation 420, various measurements may be conducted on the sample such as, for example, a pretest parameter or a pressure parameter may be measured. Also, a pump 475 may be used to draw fluid 421 from the formation 420 into the LWD tool 320 in a direction generally indicated by arrows 456. The fluid may thereafter be expelled through a port (not shown) or it may be sent to one or more fluid collecting chambers (not shown), which may receive and retain the formation fluid for subsequent testing at the surface or a testing facility. The fluid collection chambers may be of a type described, for example, in U.S. Pat. No. 7,367,394, the entirety of which is hereby incorporated herein by reference.

Optionally, the LWD tool 320 may include a fluid analysis module 470 through which the pumped fluid flows and which is configured to measure properties of the fluid being extracted from the formation 420. For example, the fluid analysis module 470 may include a fluorescence spectroscopy sensor, such as described in U.S. Patent Application Publication No. 2008/0037006, the entirety of which being incorporated herein by reference. Further, the fluid analysis module may include an optical fluid analyzer (spectrometer), for example as described in U.S. Pat. No. 7,379,180, the entirety of which is hereby incorporated herein by reference. Still further, the fluid analysis module 470 may comprise a density/viscosity sensor, for example as described in U.S. Patent Application Publication No. 2008/0257036, the entirety of which is hereby incorporated herein by reference. Yet still further, the fluid analysis module 470 may include a high resolution pressure and temperature gauges, for example as described in U.S. Pat. Nos. 4,547,691 and 5,394,345, the entireties of which being incorporated herein by reference. An implementation example of sensors in the fluid analysis module 470 may be found in SPE 108566, the entirety of which is hereby incorporated herein by reference. It should be appreciated however that the fluid analysis module 470 may include any combination of conventional and/or future-developed sensors within the scope of the present disclosure.

Still in the example of FIG. 1B, a downhole control system 480 may be configured to control the operations of the LWD module 320. For example, the downhole control system 480 may be configured to control the extraction of fluid samples from the formation 420 via the pumping rate of pump 475. The downhole control system 480 may still further be configured to analyze and/or process data obtained, for example, from fluid analysis module 470 or other downhole sensors (not shown), store and/or communicate measurement or processed data to the surface for subsequent analysis. The downhole control system 480 may include a processor configured to implement one or more aspects of the methods described herein.

While the LWD tool 320 is depicted having one probe, a plurality of probes may alternatively be provided on the LWD tool 320. Further, the LWD tool 320 may include one or more packers (e.g., an inflatable straddle packer) configured to establish fluid communication between the tool and the formation.

Also, while the LWD tool 320 is depicted as being implemented in a single drill collar, the LWD tool may be of modular type and implemented in a plurality of collars fluidly coupled with connectors, such as described in U.S. Patent Application Publication No. 2006/0283606, the entirety of which is hereby incorporated herein by reference.

Figure 2:
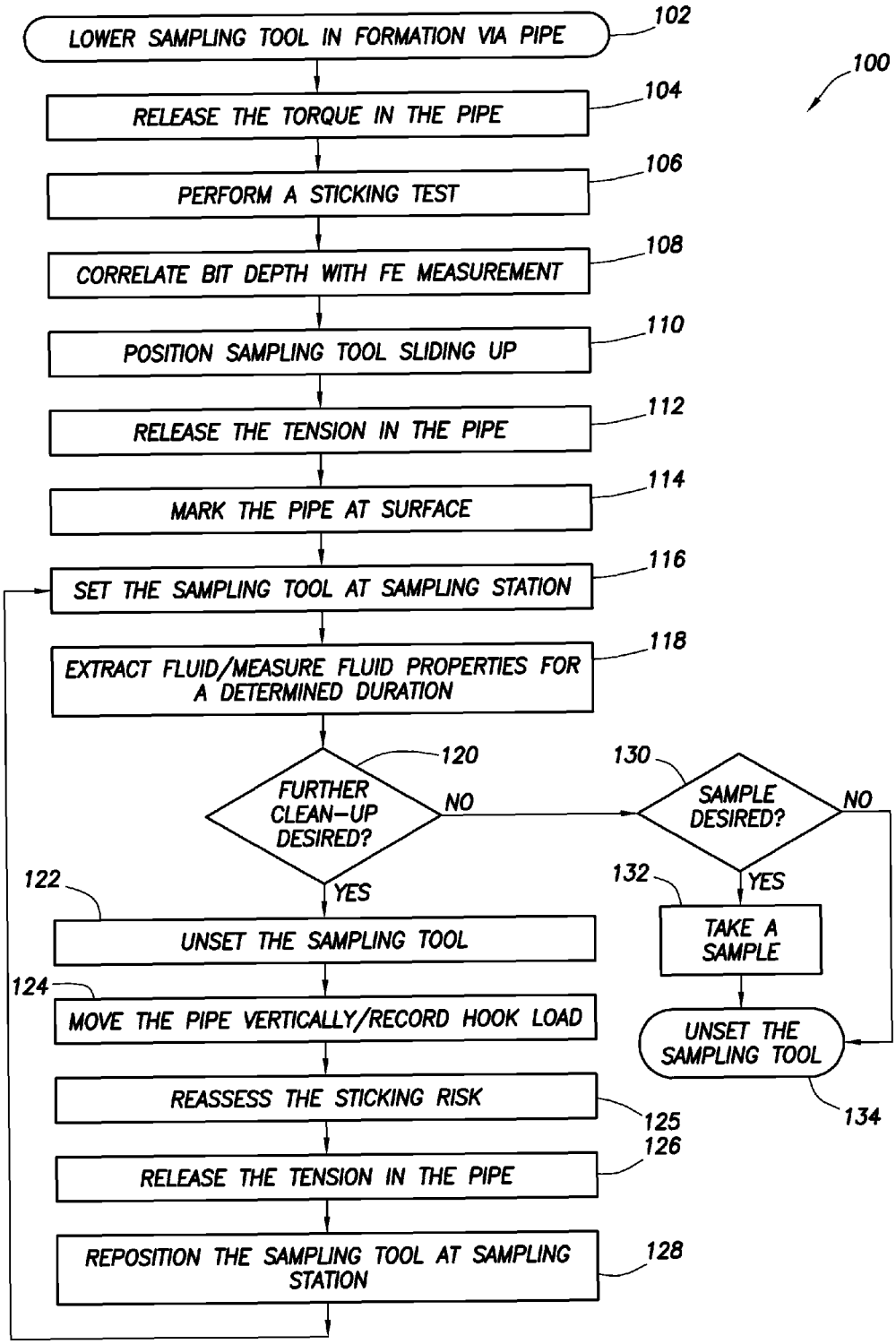
FIG. 2 is a flow-chart diagram of a method according to one or more aspects of the present disclosure.

FIG. 2 is a flow-chart diagram of a method 100 according to one or more aspect of the present disclosure. The method 100 may be utilized to reduce the risk of differential sticking during formation sampling. The method 100 may be performed using, for example, a sampling while drilling tool such as shown in FIGS. 1A and 1B. The method may also be performed using tubing, pipe and/or wireline conveyed tools. In FIG. 2, some of the steps may be rearranged, omitted, or combined with other steps, without departing from the scope of the present disclosure.

At step 102, a sampling tool (for example, the LWD tool 320 in FIGS. 1A and 1B) is lowered into the wellbore via a pipe (e.g., a drill string, a tubing, etc). Optionally, the step 102 may involve drilling a portion of the wellbore.

At step 104, the pipe is manipulated to release the torque along the length of the pipe. For example, the pipe may be moved up and down in the wellbore. An orientation of the sampling tool may be measured, for example using a direction measuring device (such as a magnetometer) and/or an inclination measuring device (such as an accelerometer) disposed in the MWD module 330 (FIG. 1A).

At step 106, a sticking test may be performed. For example, the sampling tool may be kept stationary for a predetermined duration (for example, 10 minutes) while mud circulation in the pipe is stopped. In other cases, especially if the risk of sticking is considered to be substantial, mud circulation may be maintained. Then, the pipe may be pulled up and a resulting hook load measured. The higher the measured hook load is, the higher the anticipated sticking risk. Based on this measurement, models, such as described in SPE 48963 or in "Differential Pressure Sticking of Drill String", J. D. Sherwood, AIChE Journal, Vol. 44, pp 711-721, March 1998, both incorporated herein by reference, may be calibrated and used to estimate a maximum duration on station for the sampling tool. Indeed, these models show that the sticking risk increases with time. Other ways of estimating a maximum duration on station, include, but are not limited to, operator (e.g., driller) experience, and correlation databases such as described in Schlumberger's Petrel Drilling marketing brochure, incorporated herein by reference.

At step 108, the pipe is slid down from a location, for example, above the intended sampling station. The bit depth, as described in FIG. 1A, may be correlated to a formation evaluation (FE) measurement log, such as a natural gamma ray log provided by a natural gamma ray provided by the MWD module 330 (FIG. 1A). Other logs such as density or resistivity logs may also or alternatively be used. The correlation may be used subsequently to insure proper positioning of the sampling tool.

At step 110, the pipe is slid up to the location of the intended sampling station. Similarly to step 108, the bit depth may be correlated to a formation evaluation (FE) measurement log. The correlation may differ, however, from the correlation obtained at step 108, as the tension in the pipe, and thereby its physical length, is different. It should be appreciated that the order in which steps 108 and 110 are performed may be reversed.

At step 112, the tension in the pipe is released. The step 112 may include for example determining a neutral point, as known in the art. At step 114, the pipe may be marked at the wellsite in order to provide a reference point for positioning the sampling tool.

At step 116, the sampling tool is set or deployed. For example, the stetting pistons 481 (FIG. 1B) may be extended into abutting engagement with the wall of the wellbore 311 (FIGS. 1A and 1B), thereby urging the stabilizer blade 423 (FIG. 1B) against the formation 420 (FIG. 1B). Then, the probe 406 (FIG. 1B) may be extended to contact the wellbore wall, create a fluid seal with the wellbore wall and establish fluid communication with the formation 420.

At step 118, fluid may be drawn into the downhole tool, and one or more fluid properties indicative of the extracted fluid composition, contamination, or thermo-physical properties may be monitored as pumping proceeds. For example, one or more of spectral optical density, an NMR spectrum, resistivity, density, pressure and temperature, may be measured. Contamination may be determined using methods known in the art, for example, as described in U.S. Pat. Nos. 6,274,865 and/or 6,350,986 and/or U.S. Patent Application Publication No. 2008/0156088, all of which being incorporated herein by reference. Pumping time may extend up to the maximum duration on station determined at step 106. Other composition data, such as methane content and gas oil ratio may also be determined, for example using methods described in U.S. Pat. Nos. 5,939,717 and/or 6,476,384 and/or U.S. Patent Application Publication No. 2008/0173445, which are incorporated by reference.

At step 120, a determination of whether further pumping is desirable is made. For example, the contamination level determined at the end of step 118 may be suitable for capturing a sample representative of the formation connate fluid, or for estimating a property of the connate formation fluid. Alternatively, it may be determined that no representative sample may be achieved at this location in the allotted time. In this case, the sampling operations at this location may be aborted.

A determination of whether a sample is desired may be made at step 130. If a sample is desired, one or more sample chambers conveyed in the sampling tool may be opened and a sample captured therein at step 132.

At step 134, the sampling tool may be unset (that is, the probe and the pistons are retracted into the tool), and the drilling or tripping operations may resume.

Referring back to step 120, the maximum duration on station (for example 20 minutes, 2 hours, etc.) may be reached. In some cases, the contamination level may still be too high for estimating a property of the connate formation fluid with sufficient precision and/or for capturing a representative sample. However, the contamination trend determined at step 118 may indicate that fluid representative of the connate formation fluid may be obtained after a suitable pumping duration, which, however, may be longer than the maximum allowed uninterrupted duration on station. In this case, the sampling tool may be unset at step 122.

At step 124, the pipe may be moved vertically. Moving the pipe may have the following benefits that reduce sticking occurrences:

(a) It may dislodge material that has fallen onto the BHA from above while the tool was stationary, a phenomenon commonly called "pack-off";

(b) It may loosen the mudcake that has accumulated at the edge of the contact surface between a component of the sampling tool (e.g., the probe, a blade, a setting piston) and the wellbore. Moving the pipe may have effectively the same consequence as reducing the time on station.

(c) If the hook load applied to move the tool is measured, a new estimate of the sticking risk may be made as described therein. Regular monitoring of the sticking may enable the reassessment of the maximum duration on station and consequently the adjustment of the sampling operations so that the risk is maintained at an acceptable level, as indicated at step 125.

At step 126, the tension in the pipe is released, and at step 128, the sampling tool is repositioned at the sampling station. Vertical positioning may be facilitated by one or more of the pipe markings performed at step 114, and the depth correlations performed at step 108 and/or 110. Azimuthal positioning may be also be important when the sampling tool is provided with a probe. However, when the torque has been released from the pipe as shown in step 104, and when the pipe has been moved vertically at step 126, the probe should remain aligned with the sampling location. In any case, proper alignment may be checked by comparing an orientation of the sampling tool measured at step 128, with the orientation of the sampling tool measured at step 104. The sampling operation may then resume at step 116.

The method 100 enables sampling formation while drilling while monitoring the differential sticking risk. Further, as the sticking risk is monitored, the sampling operation (such as the maximum time on station) may be adjusted to maintain this risk at an acceptable level.

Figure 3:
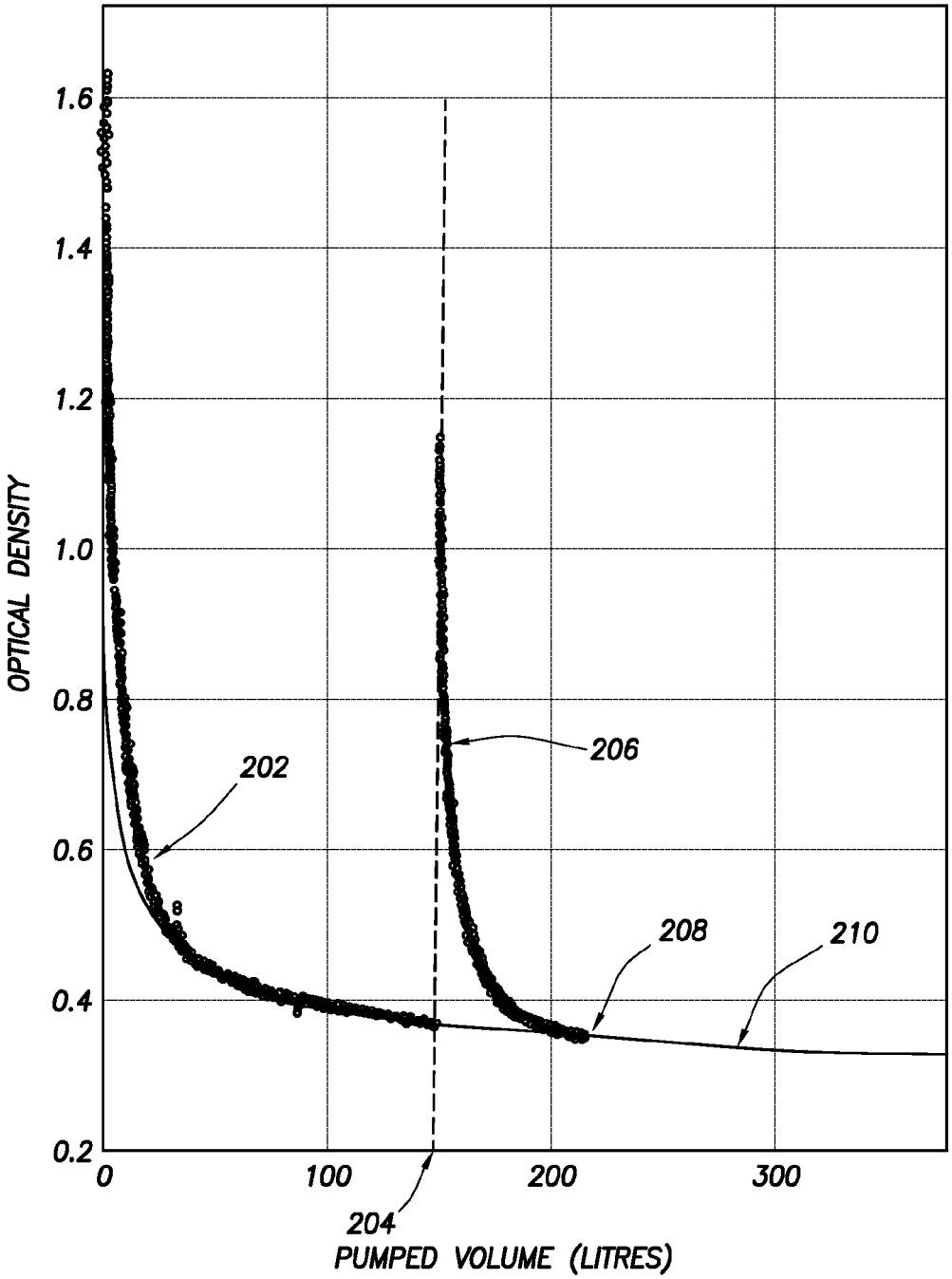
FIG. 3 is a graph depicting one or more aspects within the scope of the present disclosure.

FIG. 3 is a graph of fluid property values according to one or more aspects of the present disclosure. Referring to FIG. 3, experimental data obtained with a sampling while drilling tool disposed in a well are shown. In particular, optical density data measured by an optical spectrometer at a particular wavelength (for example, analyzer 470 in FIG. 2B) are plotted as a function of pumped volume. In this example, the mud is dyed water based mud which has a large optical density (absorbance) at that particular wavelength. The sampled fluid is underground water which has a low optical density at that particular wavelength. In this example, optical densities at a wavelength where the mud filtrate and the sample fluid exhibit adequate contrast were measured. Thus, the optical density data are indicative of a fraction of mud filtrate in the fluid extracted from the formation and therefore of a contamination level.

These data were collected while performing a sampling method as described in FIG. 2. In particular, after lowering a downhole tool in a wellbore drilled through a formation via a pipe, fluid communication between the downhole tool and the formation at a location in the wellbore was established. Subsequent to establishing fluid communication with the formation a pumping operation was begun. Fluid was extracted from the formation and passed through the downhole tool for a first duration, as indicated by an increased pumped volume up to a volume level 204, corresponding to a time on station at which sticking risk was deemed significant. A plurality of fluid property values 202 were measured as the fluid was being extracted. When the pumped volume reached the volume level 204, corresponding to a period of time which was considered safe for the tool to remain stationary in the wellbore, the fluid communication between the downhole tool and the formation was broken. The pipe was moved in the well bore, and a fluid communication between the downhole tool and the formation was reestablished at essentially the same location in the wellbore. Fluid extraction from the formation and into the downhole tool resumed for a second duration. A plurality of fluid property values 206 were measured as the fluid was being pumped.

A contamination trend 210 was determined from the plurality of fluid property values 202 using methods referenced herein. At point 208, the measured optical density is compared to the contamination trend 210. The shown example shows that the measured optical density falls on the same contamination trend.

As shown in FIG. 3, the property values 202 may indicate a progressive clean up of the fluid extracted from the formation. The effect of breaking the fluid communication at volume 204 may be as a result of a temporary reinvasion of the formation by mud filtrate. The reinvasion may be shallow and its effect may be transitory. Indeed, during the second phase of pumping, the measured fluid property values 206 realign with a contamination trend 210, as if the reinvasion at point 204 had not occurred. Thus, the graph of FIG. 3 may demonstrate that fluid having low contamination levels may be drawn and captured into sampling while drilling tool, while mitigating sticking risks using methods as described herein. Alternatively, fluid property values representative of pristine formation fluid may be measured by the sampling while drilling tool, while still mitigating sticking risks using methods as described herein.

While the graph of FIG. 3 shows an optical density at a particular wavelength, other properties such as composition, density, viscosity, fluid pressure, and/or fluid temperature, among others, may additionally or alternatively be used. In particular, methane fraction and/or GOR, determined as described herein, may be measured and a similar analysis may be performed without departing from the scope of this disclosure.

In view of all of the above and the Figures, those skilled in the art should readily recognize that the present disclosure introduces a method comprising: lowering a downhole tool via a pipe into a wellbore drilled through a formation via the pipe; establishing fluid communication between the downhole tool and the formation at a location in the wellbore; extracting from the formation a first fluid stream and passing the first fluid stream through the downhole tool for a first duration; breaking fluid communication between the downhole tool and the formation; reestablishing fluid communication between the downhole tool and the formation essentially at the location in the wellbore; extracting from the formation a second fluid stream and passing the second fluid stream through the downhole tool for a second duration; and capturing in the downhole tool a fluid sample of the second fluid stream.

The method may comprise: moving the downhole tool away from the location after breaking fluid communication between the downhole tool and the formation; and then moving the downhole tool towards the location before reestablishing fluid communication between the downhole tool and the formation essentially at the location.

The method may comprise: measuring the composition of one of the first and second fluid streams passing through the tool; and initiating the fluid sample capture based on the composition.

The method may comprise: measuring the composition of one of the first and second fluid streams passing through the tool; comparing the measured composition with a model or expected composition; and initiating the fluid sample capture based on the comparison.

The method may comprise: measuring a parameter indicative of a fraction of mud filtrate or formation connate fluid in the first or second fluid streams; and initiating the fluid sample capture based on the indicated fraction.

The method may comprise: measuring a parameter indicative of a fraction of mud filtrate or formation connate fluid in the first or second fluid streams; comparing the indicated fraction with a prediction based on a model; and initiating the fluid sample capture based on the comparison.

The method may comprise performing a sticking test.

A drill bit may be connected at a distal end of the pipe, and the method may comprise drilling the formation using the drill bit.

One of the first and second durations may be predetermined. One of the first and second durations may be predetermined based on a prediction of a model simulating sampling operations. One of the first and second durations may be predetermined based on the well or operating conditions. One of the first and second durations may be predetermined based on a sticking model in combination with a sticking tests performed in situ.

In an exemplary embodiment, establishing fluid communication between the downhole tool and the formation, extracting and passing the first fluid stream through the downhole tool for the first duration, breaking fluid communication between the downhole tool and the formation, reestablishing fluid communication between the downhole tool and the formation essentially at the location, and extracting and passing the second fluid stream through the downhole tool for the second duration, collectively, form at least one of a plurality of pumping phases; and at least one of the plurality of pumping phases comprises measuring a parameter indicative of a fraction of mud filtrate or formation connate fluid in one of the fluid streams; and the number of pumping phases included in the method is determined based on whether a rate of decline of the indicated fraction meets a threshold.

In an exemplary embodiment, establishing fluid communication between the downhole tool and the formation, extracting and passing the first fluid stream through the downhole tool for the first duration, breaking fluid communication between the downhole tool and the formation, reestablishing fluid communication between the downhole tool and the formation essentially at the location, and extracting and passing the second fluid stream through the downhole tool for the second duration, collectively, form at least one of a plurality of pumping phases; and the number of pumping phases included in the method is determined by utilizing a model capable of predicting, given a current status of contamination, the time required to reach a desired level of contamination in the extracted fluid.

The present disclosure also introduces a method comprising: lowering a downhole tool via a pipe into a wellbore drilled through a formation via the pipe; establishing fluid communication between the downhole tool and the formation at a location in the wellbore; extracting a fluid stream from the formation and passing the fluid stream through the downhole tool for a duration; breaking fluid communication between the downhole tool and the formation; moving the pipe in the wellbore; reestablishing fluid communication between the downhole tool and the formation essentially at the location in the wellbore; extracting an additional fluid stream from the formation and passing the additional fluid stream through the downhole tool for an additional duration; and measuring a property indicative of a composition of the extracted fluid during each of the durations.

The measured property may be one of a mass spectrum, an optical spectrum, and a nuclear-magnetic-resonance (NMR) spectrum.

In an exemplary embodiment, the moving, reestablishing, additional fluid stream extracting, and measuring steps, collectively, comprise a pumping sequence; and the method further comprises: successively repeating the pumping sequence; and analyzing the spectra obtained during the successive pumping sequences to determine whether the pumped fluid is of sufficient quality to capture.

Measuring the property indicative of the composition of the extracted fluid may comprise determining at least one contamination value as determined by a fraction of mud filtrate in the fluid extracted from the formation. Such method may further comprise: measuring a plurality of fluid property values indicative of a fraction of mud filtrate in the fluid extracted from the formation during the first duration; determining a contamination trend from the plurality of fluid property values; and comparing the at least one contamination value to the contamination trend.

The present disclosure also introduces a method comprising: lowering a downhole via a pipe into a wellbore drilled through a formation via the pipe; establishing fluid communication between the downhole tool and the formation at a location in the wellbore; extracting fluid from the formation and passing it through the downhole tool for a first duration; breaking the fluid communication between the downhole tool and the formation; moving the pipe in the wellbore; reestablishing fluid communication between the downhole tool and the formation essentially at the same location in the wellbore; extracting fluid from the formation and passing it through the downhole tool for a second duration; measuring a property indicative of a density or viscosity of the fluid extracted during the second duration; and measuring a pressure and temperature of the fluid extracted during the second duration.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

Moreover, one or more of the references incorporated herein by reference describe wireline implementations. However, the aspects of these references which are noted herein should be considered within the scope of the present disclosure to be applicable or readily adaptable to while-drilling implementations within the scope of the present disclosure. Similarly, aspects explicitly described in the present disclosure or otherwise within the scope of the present disclosure should be considered to be applicable or readily adaptable to both while-drilling and wireline implementations, even where such aspects are only described in the context of either while-drilling or wireline implementations.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

lowering a downhole tool via a pipe into a wellbore drilled through a formation via the pipe;

establishing fluid communication between the downhole tool and the formation at a location in the wellbore;

extracting a first fluid stream from the formation and passing the first fluid stream through the downhole tool for a first duration;

breaking fluid communication between the downhole tool and the formation;

moving the pipe in the wellbore;

reestablishing fluid communication between the downhole tool and the formation essentially at the location in the wellbore; and extracting a second fluid stream from the formation through the fluid communication and passing the second fluid stream through the downhole tool for a second duration;

wherein the steps of establishing fluid communication between the downhole tool and the formation, extracting and passing the first fluid stream through the downhole tool for the first duration, breaking fluid communication between the downhole tool and the formation, reestablishing fluid communication between the downhole tool and the formation essentially at the location, and extracting and passing the second fluid stream through the downhole tool for the second duration, collectively, form at least one of a plurality of pumping phases; and at least one of the plurality of pumping phases comprises measuring a parameter indicative of a fraction of mud filtrate or formation connate fluid in one of the fluid streams; and the number of pumping phases included in the method is determined based on whether a rate of decline of the indicated fraction meets a threshold.

2. The method of claim 1 wherein the measured parameter is one of a mass spectrum, an optical spectrum, and a nuclear-magnetic-resonance (NMR) spectrum.

3. The method of claim 2 wherein:

the moving, reestablishing, additional fluid stream extracting, and measuring steps, collectively, comprise a pumping sequence; and the method further comprises:

successively repeating the pumping sequence; and analyzing the spectra obtained during the successive pumping sequences to determine whether the pumped fluid is of sufficient quality to capture.

4. The method of claim 1 wherein measuring the parameter comprises determining at least one contamination value as determined by the fraction of mud filtrate in the first fluid extracted from the formation.

5. The method of claim 4 wherein measuring the parameter comprises:

measuring a plurality of fluid property values indicative of the fraction of mud filtrate in the first fluid extracted from the formation during the first duration;

determining a contamination trend from the plurality of fluid property values; and comparing the at least one contamination value to the contamination trend.

6. The method of claim 1 wherein establishing a fluid communication comprises extending a probe of the downhole tool to engage a wall of the wellbore.

7. The method of claim 1 comprising capturing, in the downhole tool, a fluid sample of the second fluid stream.

8. The method of claim 7 comprising:

measuring the composition of one of the first and second fluid streams passing through the tool;

comparing the measured composition with a model or expected composition; and initiating the fluid sample capture based on the comparison.

9. The method of claim 7 comprising:

comparing the indicated fraction with a prediction based on a model; and initiating the fluid sample capture based on the comparison.

10. The method of claim 1 wherein one of the first and second durations is predetermined based on a prediction of a model simulating sampling operations.

11. The method of claim 1 wherein one of the first and second durations is predetermined based on the well or operating conditions.

12. The method of claim 1 wherein one of the first and second durations is predetermined based on a sticking model in combination with a sticking test performed in situ.

13. A method, comprising:

lowering a downhole tool via a pipe into a wellbore drilled through a formation via the pipe;

establishing a fluid communication between the downhole tool and the formation at a location in the wellbore;

extracting a first fluid from the formation and passing it through the downhole tool for a first duration;

breaking the fluid communication between the downhole tool and the formation;

moving the pipe in the wellbore;

reestablishing fluid communication between the downhole tool and the formation essentially at the same location in the wellbore; and extracting a second fluid from the formation and passing it through the downhole tool for a second duration;

wherein the steps of establishing fluid communication between the downhole tool and the formation, extracting and passing the first fluid stream through the downhole tool for the first duration, breaking fluid communication between the downhole tool and the formation, reestablishing fluid communication between the downhole tool and the formation essentially at the location, and extracting and passing the second fluid stream through the downhole tool for the second duration, collectively, form at least one of a plurality of pumping phases; and the number of pumping phases included in the method is determined by utilizing a model capable of predicting, given a current status of contamination, the time required to reach a desired level of contamination in the extracted fluid.

14. The method of claim 13 comprising measuring a property indicative of a composition of the extracted fluid of each of the first and second fluid streams.

15. The method of claim 13 comprising measuring a property indicative of a density or viscosity of the extracted fluid of the second fluid stream; and measuring a pressure and temperature of the extracted fluid of the second fluid stream.

16. The method of claim 13 wherein a drill bit is connected at a distal end of the pipe, and wherein the method further comprises drilling the formation using the drill bit.

17. The method of claim 13 comprising capturing, in the downhole tool, a fluid sample of the second fluid stream.

18. The method of claim 17 comprising:

measuring the composition of one of the first and second fluid streams passing through the tool;

comparing the measured composition with an expected composition based on the model; and initiating the fluid sample capture based on the comparison.

19. The method of claim 17 comprising:

measuring a parameter indicative of a fraction of mud filtrate or formation connate fluid in the first or second fluid streams;

comparing the indicated fraction with a prediction based on the model; and initiating the fluid sample capture based on the comparison.

20. The method of claim 13, further comprising wherein the number of pumping phases is determined based on a sticking test.

* * * * *